US006494727B2

(12) United States Patent
Wen-Ching

(10) Patent No.: US 6,494,727 B2
(45) Date of Patent: Dec. 17, 2002

(54) POSITIONING MECHANISM OF FOLDABLE PLUG AND STRUCTURE OF CONNECTOR HAVING THE SAME

(75) Inventor: Wu Wen-Ching, Taoyuan (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 09/960,894

(22) Filed: Sep. 21, 2001

(65) Prior Publication Data

US 2002/0119687 A1 Aug. 29, 2002

(30) Foreign Application Priority Data

Feb. 27, 2001 (TW) ..... 90202965 U

(51) Int. Cl.[7] ..... H01R 13/44
(52) U.S. Cl. ..... 439/131
(58) Field of Search ..... 439/131, 104, 439/103, 172

(56) References Cited

U.S. PATENT DOCUMENTS 5,628,641 A * 5/1997 Hahn ..... 439/131
6,062,880 A * 5/2000 Skuza ..... 439/131
6,275,002 B1 * 8/2001 Chen ..... 439/131
6,312,271 B1 * 11/2001 Tseng ..... 439/131

* cited by examiner

*Primary Examiner*—Gary Paumen
(74) *Attorney, Agent, or Firm*—Alston & Bird LLP

(57) ABSTRACT

A positioning mechanism of a foldable plug is provided. The positioning mechanism includes a plug having a rod and two pins, the rod having a first recess and a second recess, a positioning device formed by injection molding and having a resilient projection and a first connecting device, a second connecting device for coupling with the first connecting device and supporting the plug, and a third connecting device for coupling with the second connecting device, wherein when the resilient projection is inserted into the first recess of the plug, the plug is secured to be held in a first position, and when the resilient projection is inserted into the second recess of the plug, the plug is secured to be held in a second position.

18 Claims, 7 Drawing Sheets

POSITIONING MECHANISM OF FOLDABLE PLUG AND STRUCTURE OF CONNECTOR HAVING THE SAME

FIELD OF THE INVENTION

The present invention relates to a positioning mechanism of a foldable plug, and more particularly to a structure of a connector having the same.

BACKGROUND OF THE INVENTION

An electrical connector principally includes an insulating housing, a plug and a circuit mounted within the housing. The plug transmits a first power supply, e.g., a commercial AC power supply, to the circuit for further performing rectification and/or conversion into a second power supply, for example a low-voltage AC or DC power supply. The second power supply is provided for a power-receiving device such as a modem, a printer and a notebook. The plug of a typical connector usually as two conducting pins projected from one surface of the housing. When the connector is not in use, a person may get hurt by the tips of projected pins. Thus, a connector having a foldable plug has been developed. FIGS. 1(*a*) and 1(*b*) respectively show the perspective view and cross-sectional view of a typical connector which has a foldable plug. Such connector includes a housing 10 and a plug 11. The housing further has a storage portion 12 near the top edge of the housing 10. The plug 11 mainly includes a rod 111 having a tenon 114 on each end thereof, two first pins 112 and two second pins 113. The first pins 112 and the second pins 113 respectively have holes 115 and 116 corresponding to the tenon 114 for inserting the tenon 114 therethrough so as to make the combination of the first pins 112, the second pins 113 and the rod 111. Each side wall of the storage portion 12 has a spring receptacle 121 containing a spring 122. The ends of the spring 122 are respectively in contact with a side of the spring receptacle 121 and a cavity 117 of the first pin 112 via a fixing element 123. The plug is positioned in the storage portion 12 by the resilience force of the springs 122 and folded by adjusting the first pins 112 to drive the second pins 113 and rotate the rod 111. Therefore, the plug 11 is electrically connected to the circuit mounted inside the housing 11.

Although the above-mentioned connector has a foldable plug, the connector still has the following drawbacks:

1. Five elements, i.e. one rod 111, two first pins 112, two seconds pins 113, are required for assembling the plug 10; furthermore, assembling the connector further needs two springs 122, two fixing elements 123, one upper housing and one lower housing of the insulating housing 10 and one circuit board (not shown); that is to say, thirteen elements are required to assemble the connector, which is costly in managing and fabricating the elements.
2. The process for assembling the plug 10 is complicated and the first pins 112 and the second pins 113 are easily detached from the tenon 114.
3. The ends of the spring 122 are respectively in contact with a side of the spring receptacle 121 and a cavity 117 of the first pin 112 via a fixing element 123, which is labor-intensive.
4. When the plug 10 is switched to the storage position 12, the spring 122 is twisted such that the electric fatigue of the spring 122 is found for a long term.

Therefore, the present invention provides an improved positioning mechanism of a foldable plug so as to overcome the problems described above.

SUMMARY OF THE INVENTION

It is an object of the present invention to provide a positioning mechanism of a foldable plug, which requires fewer assembling elements.

It is another object of the present invention to provide a positioning mechanism of a foldable plug, wherein the plug is securely held in either a folded position or an upright position.

It is another object of the present invention to provide a structure of a connector having a foldable plug, which is easily assembled so as to reduce manufacturing cost and time.

In accordance with an aspect of the present invention, the positioning mechanism of a foldable plug includes a plug having a rod and two pins wherein the rod has a first recess and a second recess, a positioning device formed by injection molding and having a resilient projection and a first connecting device, a second connecting device for coupling with the first connecting device and supporting the plug, and a third connecting device for coupling with the second connecting device, wherein when the resilient projection is inserted into the first recess of the plug, the plug is securely held in a first position, and when the resilient projection is inserted into the second recess of the plug, the plug is securely held in a second position.

Preferably, the rod is coupled with the pins by plastic molding.

Preferably, the positioning device is formed of a thermoplastic material.

Preferably, the resilient projection is semi-cylinder shaped.

Preferably, the first connecting device is a rectangular body extending from a surface of said positioning device.

Preferably, the second connecting device includes two first plates, each plate having a groove corresponding to the rectangular body and a first notch formed on the top surface thereof.

Preferably, both ends of the rod are cylinder-shaped and carried on the first notch.

Preferably, the third connecting device includes two second plates, each plate having a second notch corresponding to the first notch.

Preferably, the second notch is semi-cylinder shaped.

In accordance with another aspect of the present invention, there is provided a structure of a connector having a foldable plug. The structure includes a plug having a rod and two pins, the rod having a first recess and a second recess, a positioning device formed by injection molding and having a resilient projection and a first connecting device, a lower housing having a second connecting device for coupling with the first connecting device and supporting the plug, an upper housing having a third connecting device for coupling with the second connecting device, and a circuit mounted between the lower housing and the upper housing for converting the first electric signal into the second electric signal, wherein when the resilient projection is inserted into the first recess of the plug, the plug is securely held in a first position, and when the resilient projection is inserted into the second recess of the plug, the plug is securely held in a second position.

Preferably, the rod is coupled with the pins by plastic molding.

Preferably, the connector is an adapter and the power-receiving device is an electrical appliance.

Preferably, the connector is a charger and the power-receiving device is a rechargeable battery.

Preferably, the lower housing of the connector is mounted on a cover of an electrical appliance.

Preferably, the first position is an upright position and the second position is a folded position.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 1(*b*) is a cross-sectional view showing the structure of the connector in FIG. 1(*a*);

FIG. 3(*b*) is a perspective view showing the foldable plug is in an upright position according to the present invention;

FIG. 4(*b*) is a schematic sectional view illustrating the foldable plug is being adjusted from the folded direction to the upright position according to the present invention; and FIG. 4(*c*) is a schematic sectional view illustrating the foldable plug is positioned in an upright position according to the present invention.

DETAILED DESCRIPTION OF THE PREFERRED EMBODIMENT

Figure 1A:
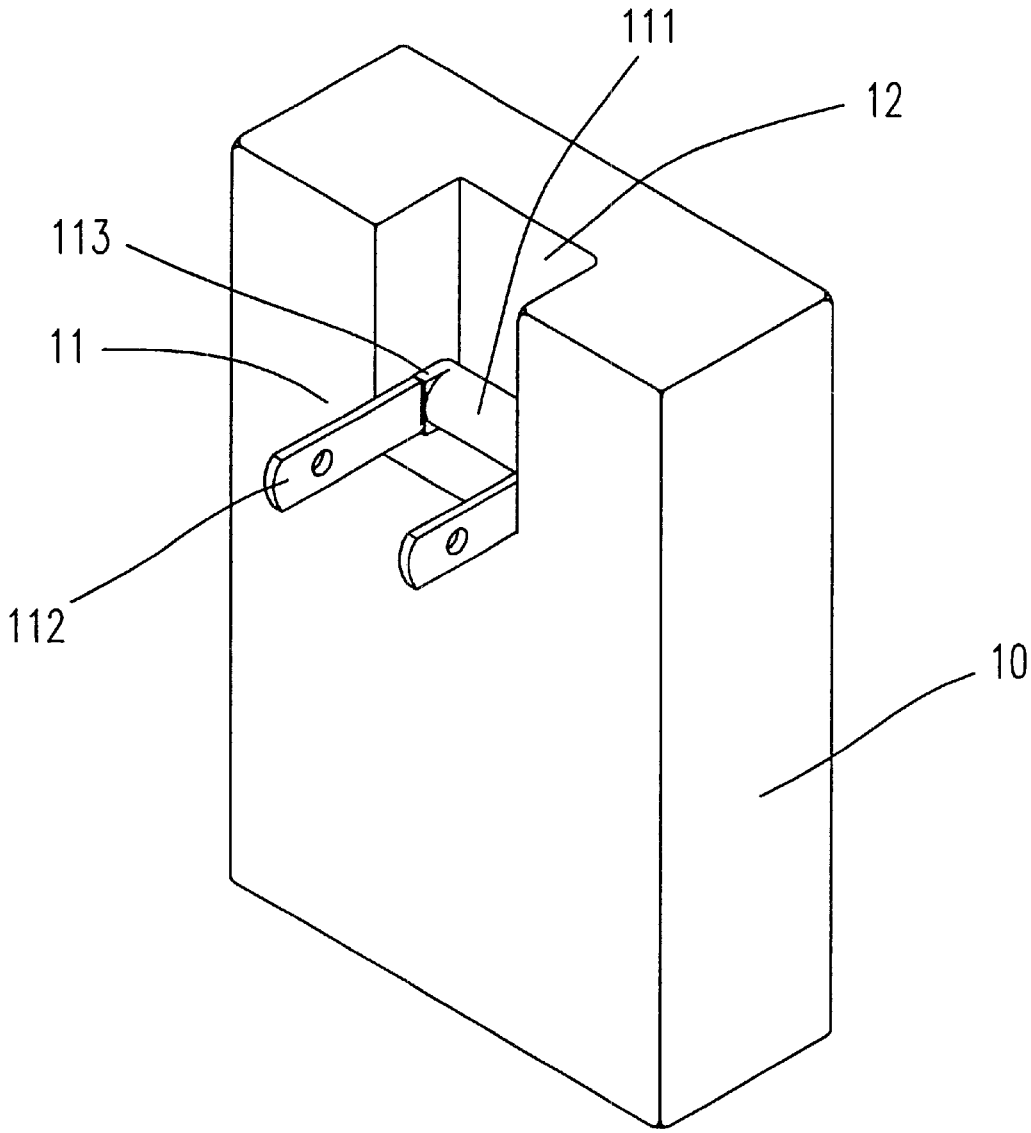
Fig. 1(a)(PRIOR ART)
FIG. 1(*a*) is a perspective view showing a connector having a foldable plug according to prior art.
Figure 1B:
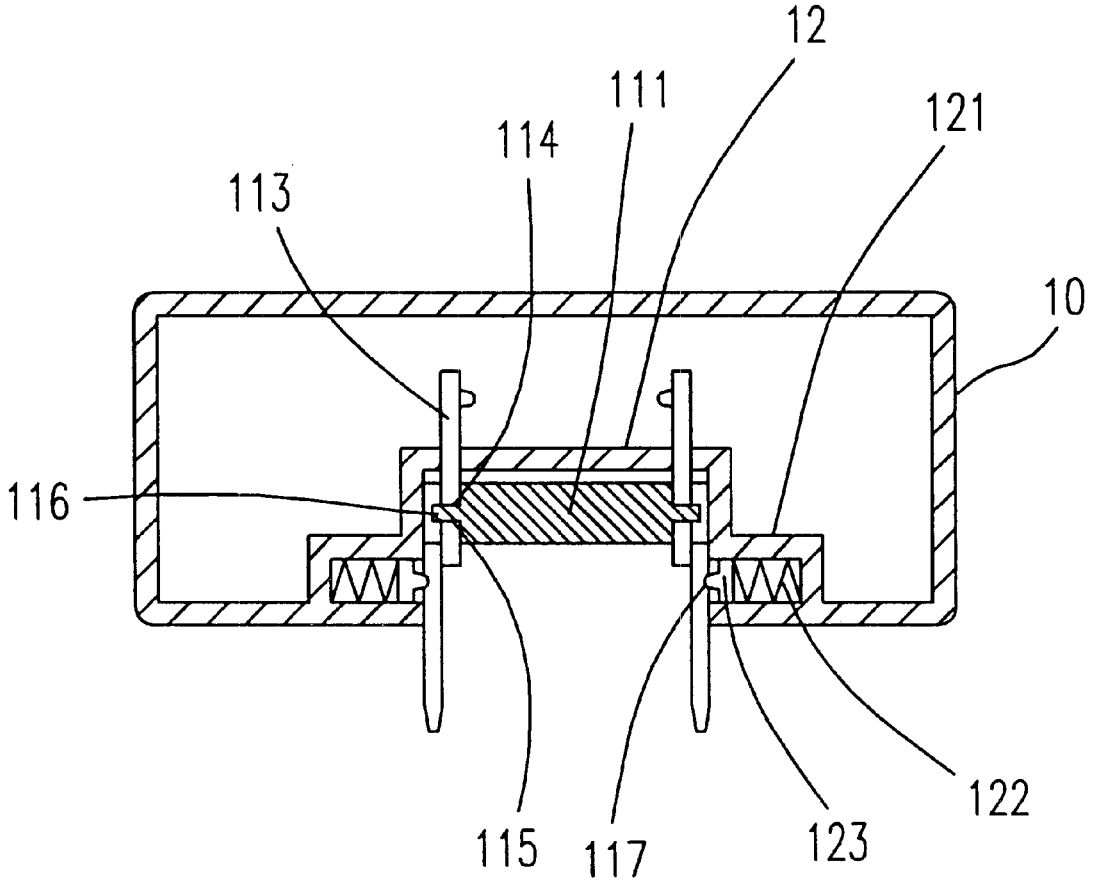
Fig. 1(b)(PRIOR ART)
Figure 2:
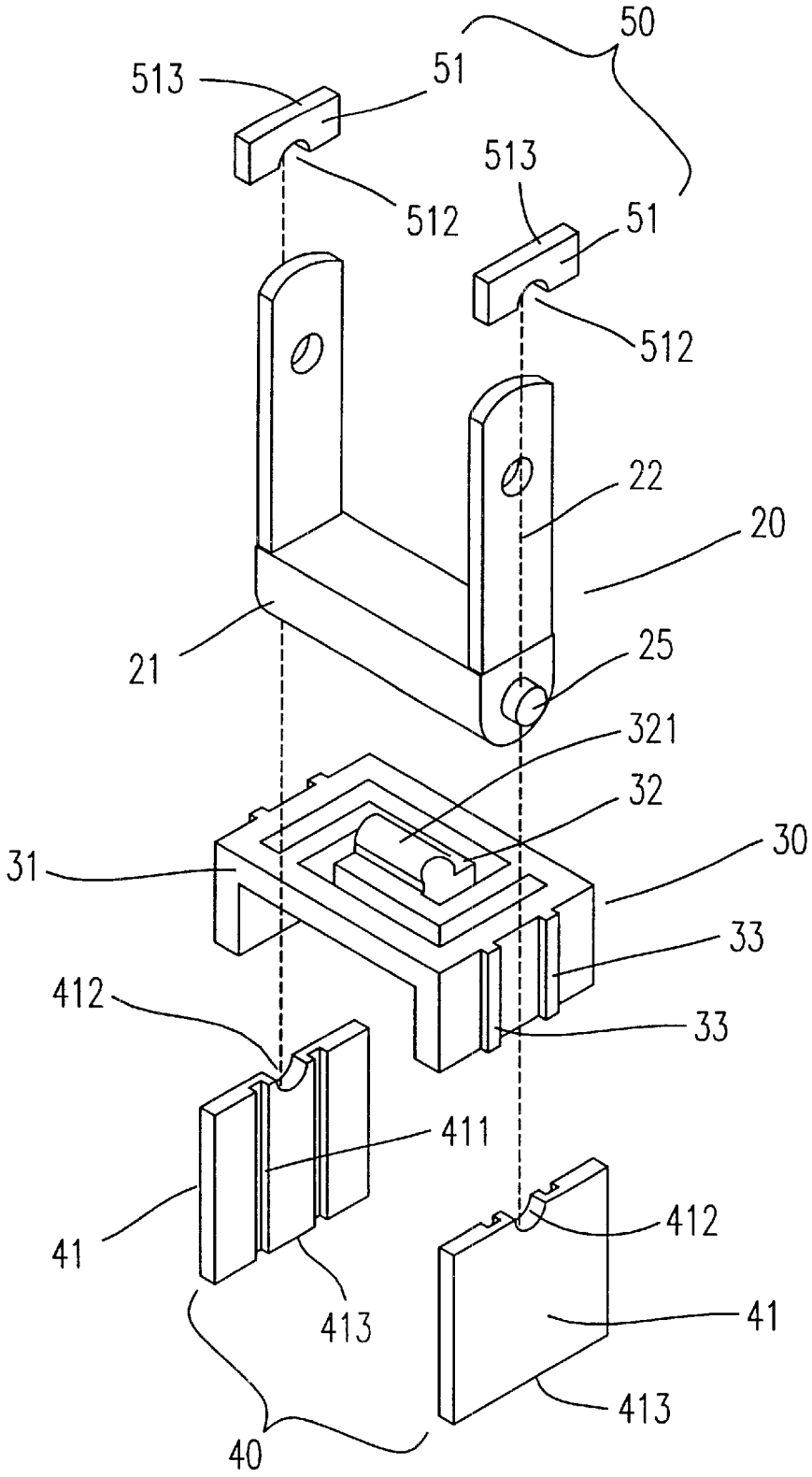
FIG. 2 is a view illustrating the positioning mechanism of a foldable plug according to a preferred embodiment of the present invention.
Figure 3A:
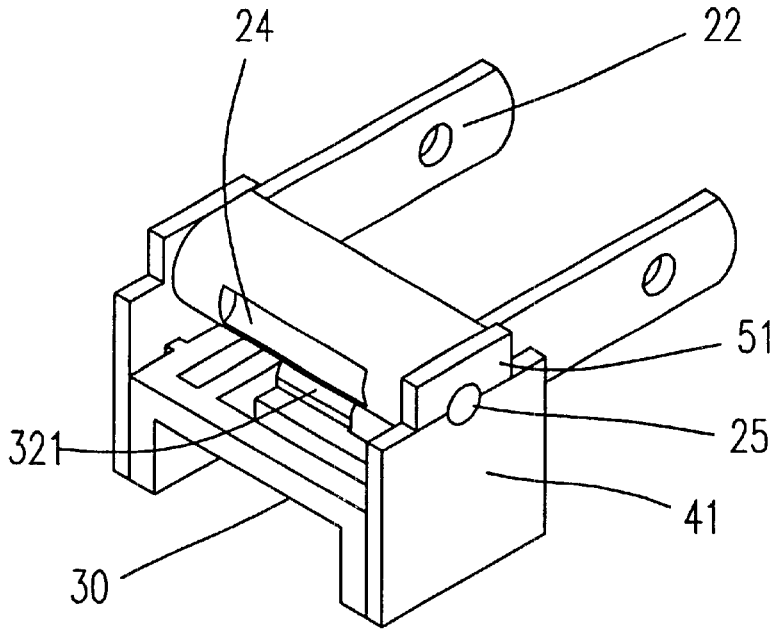
FIG. 3(*a*) is a perspective view showing the foldable plug is in a folded position according to the present invention.
Figure 3B:
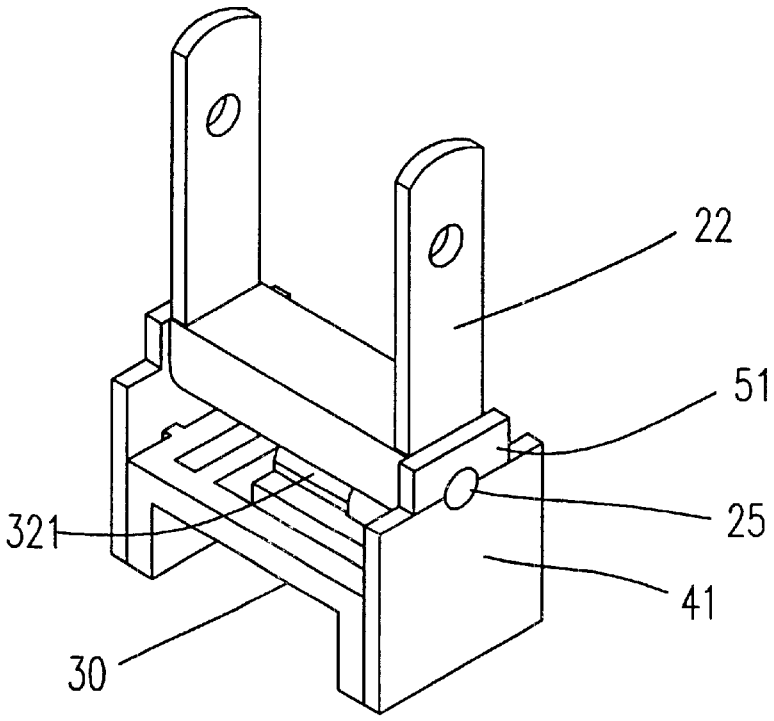
Figure 4A:
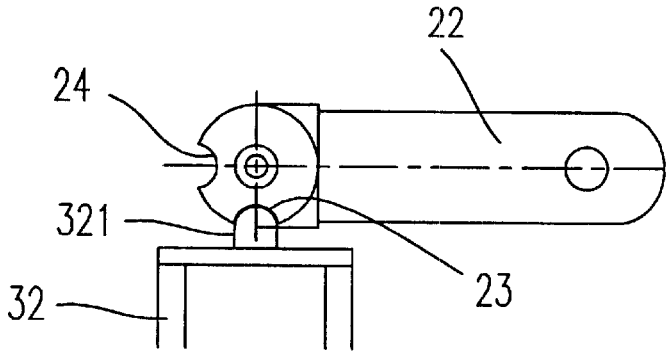
FIG. 4(*a*) is a schematic view illustrating the foldable plug is positioned in a folded position according to the present invention.
Figure 4B:
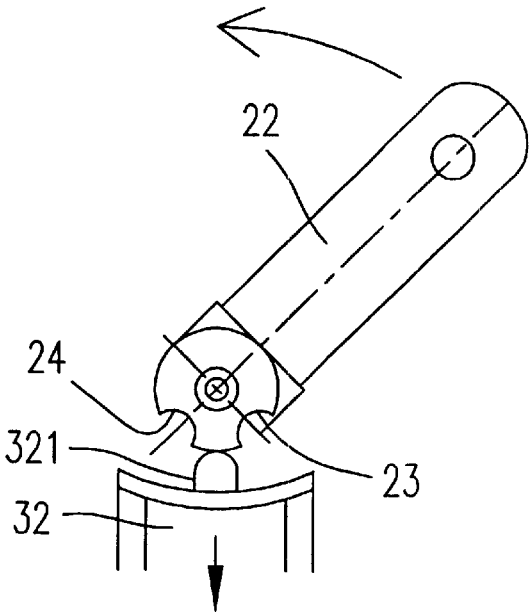
Figure 4C:
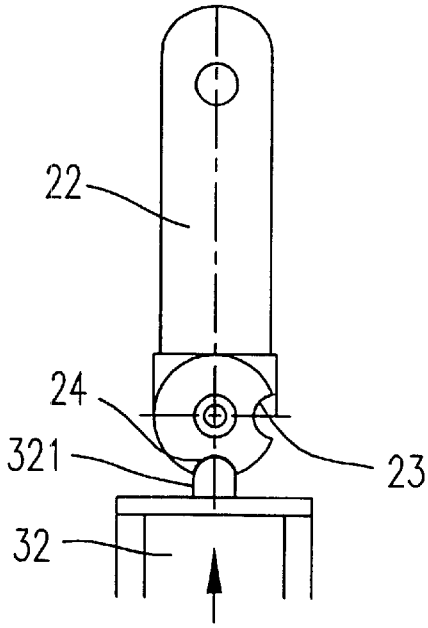
Figure 5:
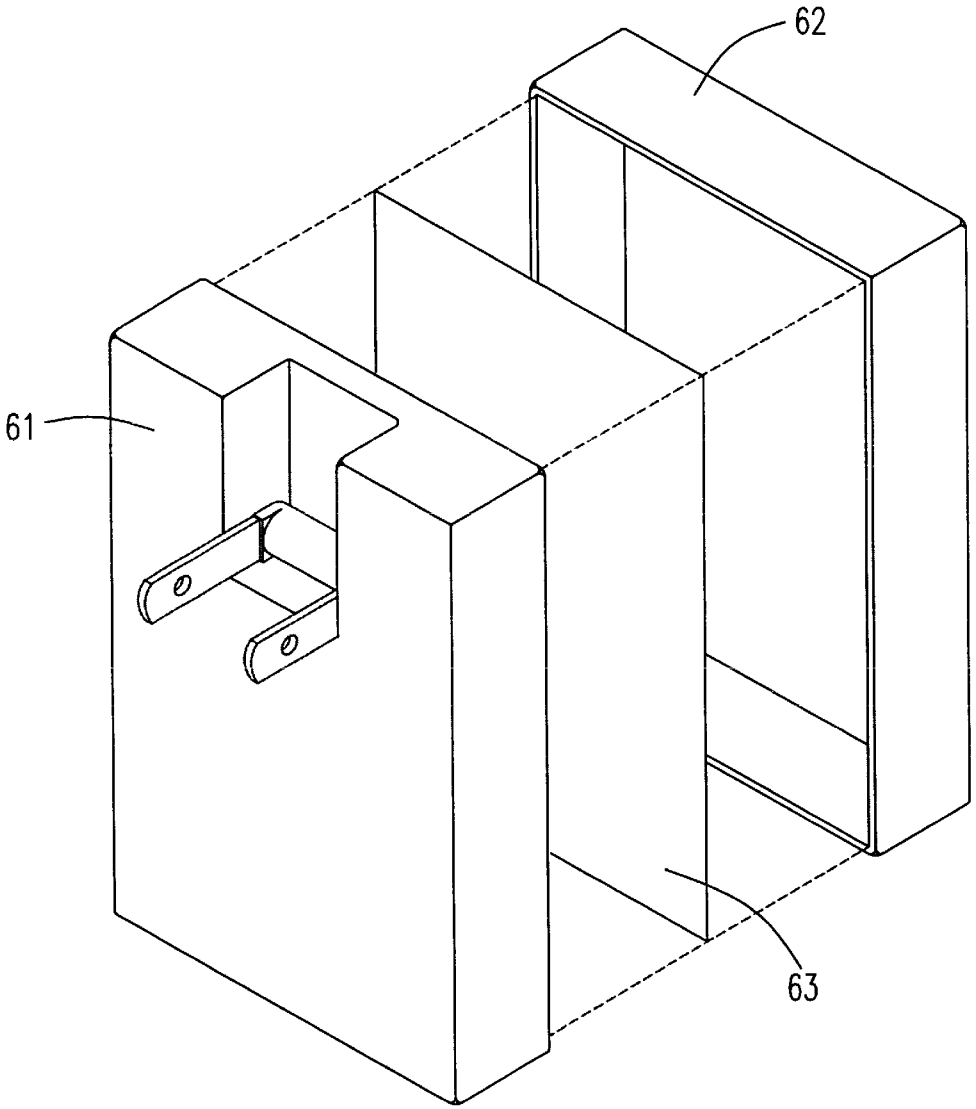
FIG. 5 is an exploded view of the foldable plug.

Please refer to FIGS. 2, 3(*a*), 3(*b*) and 4(*a*) to 4(*c*). The positioning mechanism of a foldable plug according to a preferred embodiment of the present invention includes a plug 20, a positioning device 30 with first connecting devices 33, a second connecting device 40 and a third connecting device 50. The plug 20 includes a rod 21 and two pins 22. The two pins 22 are coupled with the rod 21 by plastic molding. The rod 21 has a first recess 23 and a second recess 24 formed on the body thereof, as can be seen in FIG. 4(*a*), and both ends 25 of the rod 21 are cylinder-shaped. The positioning device 30 includes a base 31 and a resilient member 32, which are integrally formed by plastic injection molding. Referring to FIG. 2, the base 31 further includes two rectangular solids, i.e. the first connecting devices 33, projected from both sides thereof. The top center 321 of the resilient member 32 is projected upwards, which is also called a resilient projection, and in a shape of semi-cylinder for mounting into the first recess 23 or the second recess 24 of the plug 20. The second connecting device 40 includes two parallel first plates 41. Each plate 41 has two rectangular grooves 411 corresponding to the first connecting device 33 and a semi-cylinder shaped notch 412 formed on the top surface thereof. The third connecting device 50 includes two parallel second plates 51. Each plate 51 has a semi-cylinder shaped notch 512 on the bottom surface thereof corresponding to the semi-cylinder shaped notch 412 of the first plates 41.

The process for assembling the foldable plug 20 includes steps of coupling the positioning device 30 with the second connecting devices 41 by coupling the connecting device 33 with the rectangular ditches 411, allowing the ends 25 of the plug 20 to be carried out on the notch 412 of the second connecting devices 41 and securing the first recess 23 or the second recess 24 with the top center 321 of the resilient member 32, and finally coupling the second connecting device 41 and the third connecting device 51 by coupling the notches 412 and 512. There is a space between the ends 25 of the plug 20 and the notches 412 and 512 such that the plug 20 is capable of rotating.

Please refer to FIGS. 4(*a*) to 4(*c*). When the resilient projection 321 is inserted into the first recess 23 of the plug 20, the plug 20 is held in a first position, i.e. a stored position or a folded position, as can be seen in FIG. 4(*a*). Referring to FIG. 4(*b*), when the plug is switched between the first position and a second position, i.e., an upright position, the resilient projection 321 is pushed downwards and thus detached from the first recess 23. Meanwhile the resulting force acted on the plug 20 is not in equilibrium such that the plug 20 is not effectively positioned. When the plug 20 is continuously switched and the resilient projection 321 is inserted into the second recess 24 of the plug 20, the plug 20 is held in the second position, i.e. the upright position or a conducting position, as can be seen in FIG. 4(*c*). When the plug 20 is switched to the upright position, the pins 22 of the plug 20 can accept the external power supply.

Figure 6:
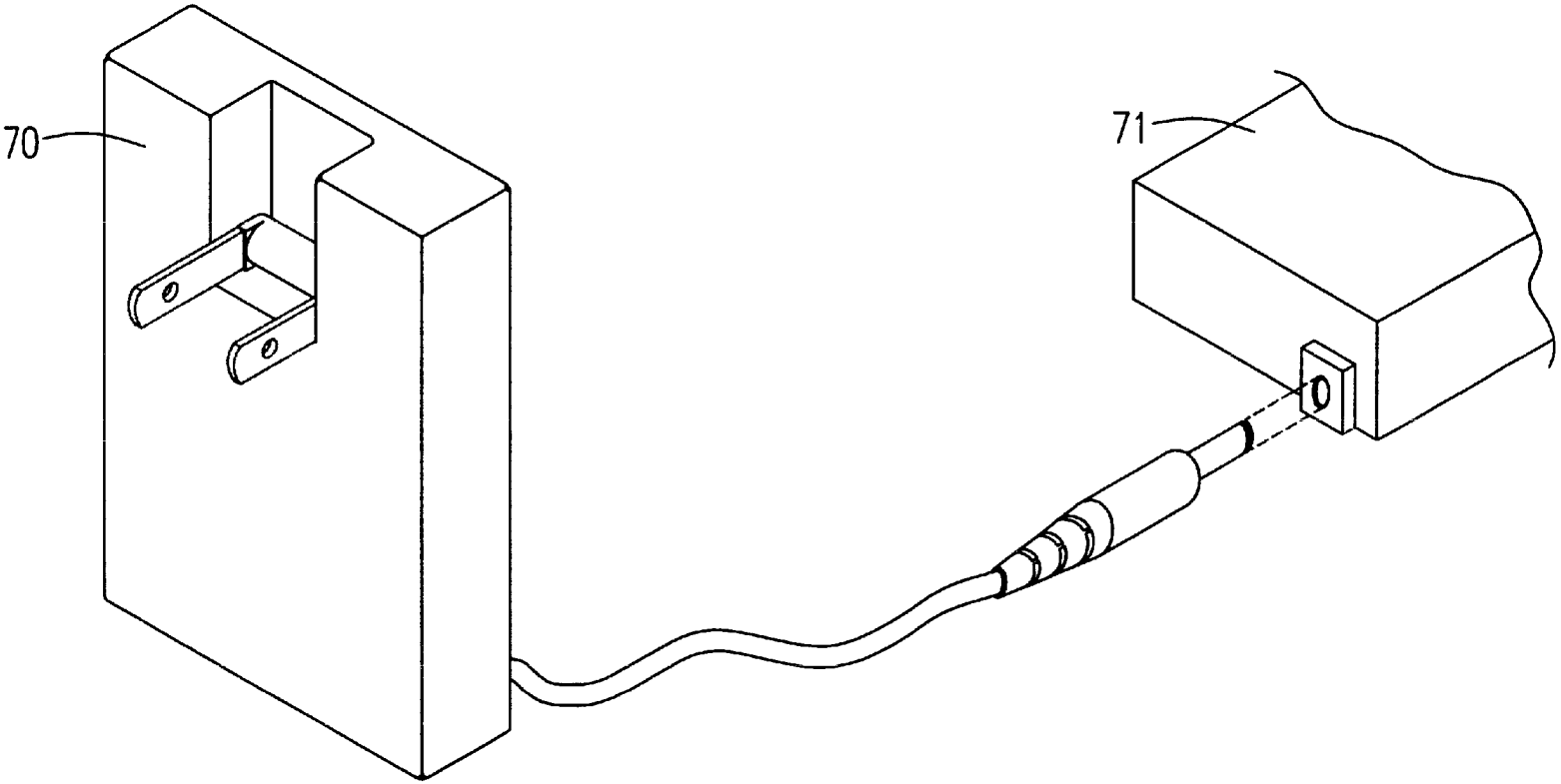
FIG. 6 is a perspective view showing the foldable plug connected to an adaptor.

It is of course evident that the positioning mechanism of the foldable plug according to the present invention can be applied to a connector. For example, the bottom surface 413 of the second connecting device 40 is coupled with a lower housing (not shown) of the connector and the top surface 513 of the third connecting device 50 is coupled with an upper housing of the connector. Also, the second connecting devices 40 and the third connecting devices 50 can be integrally formed with the lower housing and the upper housing of the connector, respectively. Preferably, the connector is an adapter (not shown) or a battery charger (not shown). The arrangement and the operation principle of the circuit mounted between the upper housing and the lower housing are known to those skilled in the art. It will be understood that the circuit is dependent on the function of the connector, for example, to perform rectification and/or conversion for a power-receiving device. Please refer to FIG. 6. When the connector is an adapter 70, the power-receiving device is an electrical appliance such as a notebook or a printer. When the connector is applied to a charger, the power-receiving device 71 is a rechargeable battery. Certainly, the connector of the present invention could be constructed on a lower housing of an electrical appliance (not shown), for example a thermos bottle or a razor, by mounting the second connecting device 40 on a cover thereof.

As will be apparent from the above description according to the present invention, the positioning mechanism of the foldable plug and the assembling structure of a connector including a foldable plug have the advantages as follows:

1. The positioning device 30 can be used to replace two springs in the prior art owing to its plastic resilience and its good effect on positioning the plug.
2. The positioning device 30 is easily fabricated, which has less manufacturing cost and time.

3. The springs 122 in the prior art always continuously provide resilience force to support the plug, no matter where the plug is folded; however, the positioning device 30 of the present invention provides a resilient force to urge against the rod 21 of the plug 20 only when the plug 20 is being adjusted from the first position to the second position or from the second position to the first position and the resilient force is relieved when the plug is oriented on the first position or the second position. Therefore, the positioning device 30 according to the present invention has longer operating life than the springs in the prior art.
4. The first pins 112 and the second pins 113 are easily detached from the tenon 114 in the prior art; however, the pins 22 and the rod 21 of the plug 21 according to the present invention are formed by plastic molding, which could overcome the above drawback in the prior art.
5. Only five elements, i.e. one upper housing 61, one plug 20 one positioning device 30, one circuit 63 and one lower housing 62 are required to assemble the connector of the present invention, which has more benefits in material management and product yield and has less assembling time and manufacturing cost than those of prior art.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A foldable plug having a positioning mechanism, comprising:

a plug having a rod and two pins, said rod having a first recess and a second recess;

a positioning device formed by injection molding and having a resilient projection and a first connecting device;

a second connecting device for coupling with said first connecting device and supporting said plug; and a third connecting device for coupling with said second connecting device, wherein when said resilient projection is inserted into said first recess of said plug, said plug is securely held in a first position, and when said resilient projection is inserted into said second recess of said plug, said plug is securely held in a second position.

2. The plug according to claim 1, wherein said rod is coupled with said pins by plastic molding.

3. The plug according to claim 1, wherein said positioning device is formed of a thermoplastic material.

4. The plug according to claim 1, wherein said resilient projection is semi-cylinder shaped.

5. The plug according to claim 1, wherein said first connecting device is a rectangular body extending from a surface of said positioning device.

6. The plug according to claim 5, wherein said second connecting device includes two first plates, each plate having a groove corresponding to said rectangular body and a first notch formed on a top surface thereof.

7. The plug according to claim 6, wherein both ends of said rod are cylinder-shaped and carried on said first notches.

8. The plug according to claim 7, wherein said third connecting device comprises two second plates, each plate having a second notch corresponding to a respective one of said first notches.

9. The plug according to claim 8, wherein said second notch is semi-cylinder shaped.

10. A structure of a connector for accepting a first electric signal and transmitting a second electric signal to a power-receiving device, comprising:

a plug having a rod and two pins, said rod having a first recess and a second recess;

a positioning device formed by injection molding and having a resilient projection and a first connecting device;

a lower housing having a second connecting device for coupling with said first connecting device and supporting said plug;

an upper housing having a third connecting device for coupling with said second connecting device; and a circuit mounted between said lower housing and said upper housing for converting said first electric signal into said second electric signal, wherein when said resilient projection is inserted into said first recess of said plug, said plug is securely held in a first position, and when said resilient projection is inserted into said second recess of said plug, said plug is securely held in a second position.

11. The structure according to claim 10, wherein said rod is coupled with said pins by plastic molding.

12. The structure according to claim 10, wherein said connector is an 11 adapter.

13. The structure according to claim 12, wherein said power-receiving device is an electrical appliance.

14. The structure according to claim 10, wherein said connector is a charger.

15. The structure according to claim 14, wherein said power-receiving device is a rechargeable battery.

16. The structure according to claim 10, wherein said lower housing of said connector is mounted on a cover of an electrical appliance.

17. The structure according to claim 10, wherein said first position is an upright position.

18. The structure according to claim 17, wherein said second position is a folded position.

* * * * *